US005542183A

United States Patent [19]

Allison

[11] Patent Number: 5,542,183

[45] Date of Patent: Aug. 6, 1996

[54] FIREFIGHTER'S CEILING CUTTING TOOL

[76] Inventor: Philip Allison, 283 Marbledale Rd., Tuckahoe, N.Y. 10707

[21] Appl. No.: 362,772

[22] Filed: Dec. 23, 1994

[51] Int. Cl.[6] ..... B26B 7/00

[52] U.S. Cl. ..... 30/276; 30/391

[58] Field of Search ..... 30/276, 277.4, 30/286, 295, 382, 390, 391; 83/478, 544, DIG. 1

[56] References Cited

U.S. PATENT DOCUMENTS

| | | | |
|---|---|---|---|
| 2,274,421 | 2/1942 | Lindstrom et al. | 30/390 |
| 3,812,584 | 5/1974 | Peter | 30/276 |
| 4,081,906 | 4/1978 | Sigler | 30/276 |
| 4,226,021 | 10/1980 | Hoff | 30/276 |
| 4,976,031 | 12/1990 | Miller | 30/276 |

*Primary Examiner*—Hwei-Siu Payer
*Attorney, Agent, or Firm*—Martin J. Spellman, Jr.

[57] ABSTRACT

A fire fighter's tool for cutting through ceiling and wall panels which includes a base shaft within which telescoping expandable tubular sections are stored. The base shaft carries a power cord reel, counterbalance, and a control handle. A retractable power cord extends through the core of the extendable tubular sections to a motor mounted at the distal end of the outermost telescoping tubular section. The motor is encased within a waterproof enclosure and the shaft of the motor turns concentrically with the axis of the extendable tubular shafts. Gears and belt driving means connect the motor to a transverse shaft rotating a circular cutting blade on an axis perpendicular to the axis of the extendable tubes. The blade is provided with a pair of fan-like shields spring biased to substantially enclose the blade when it is not actively cutting, but which retract to expose the blade when slight pressure is applied thereto when the tool is in use.

6 Claims, 13 Drawing Sheets

FIG.10
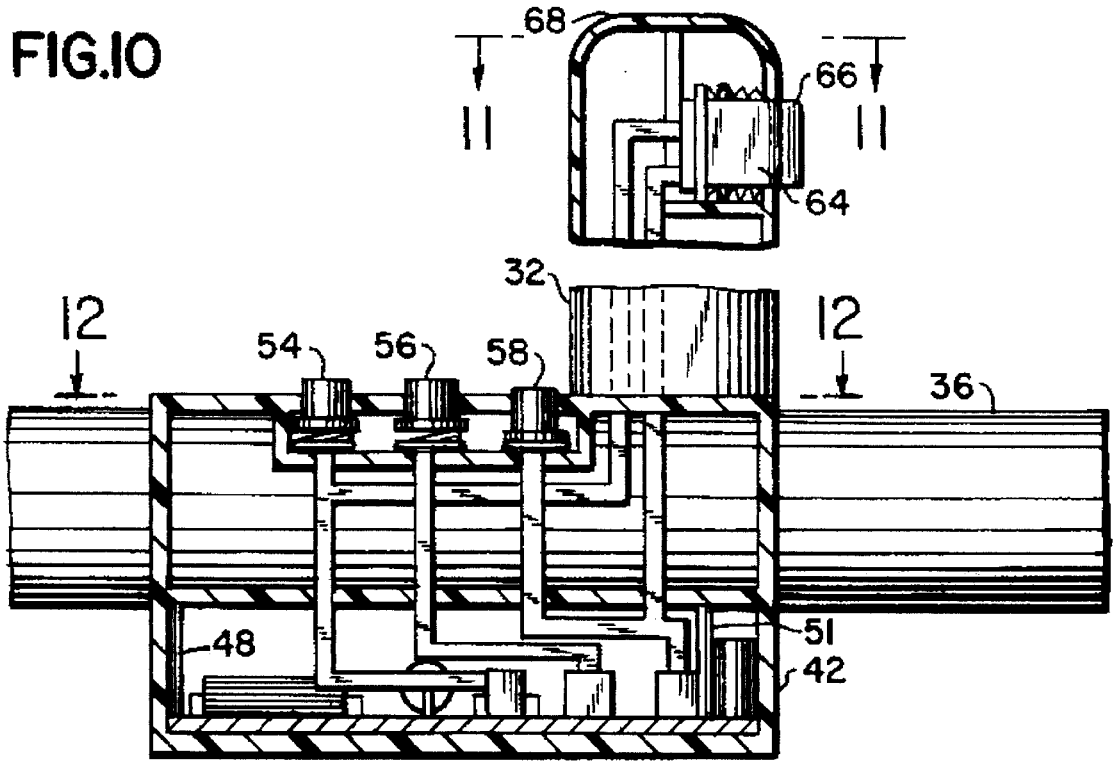
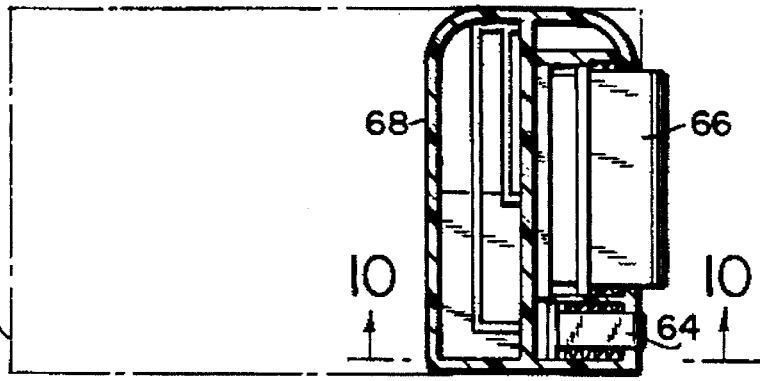
FIG.11
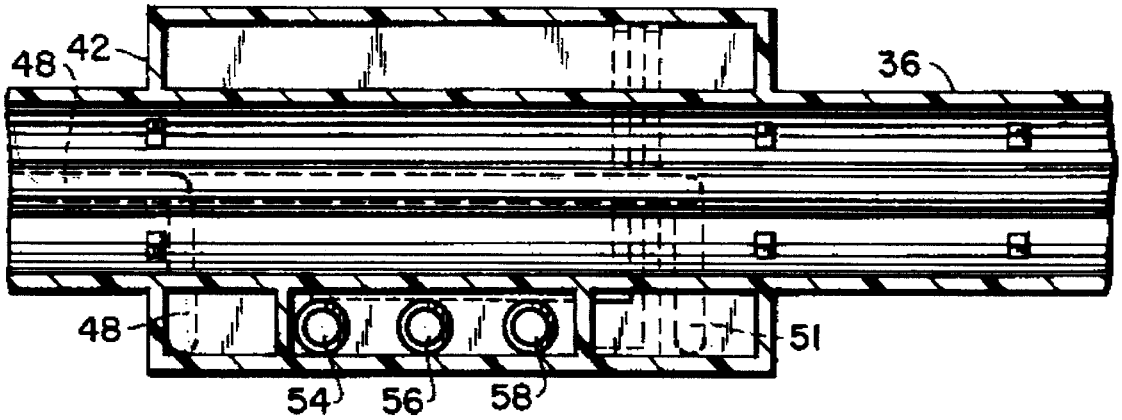
FIG.12

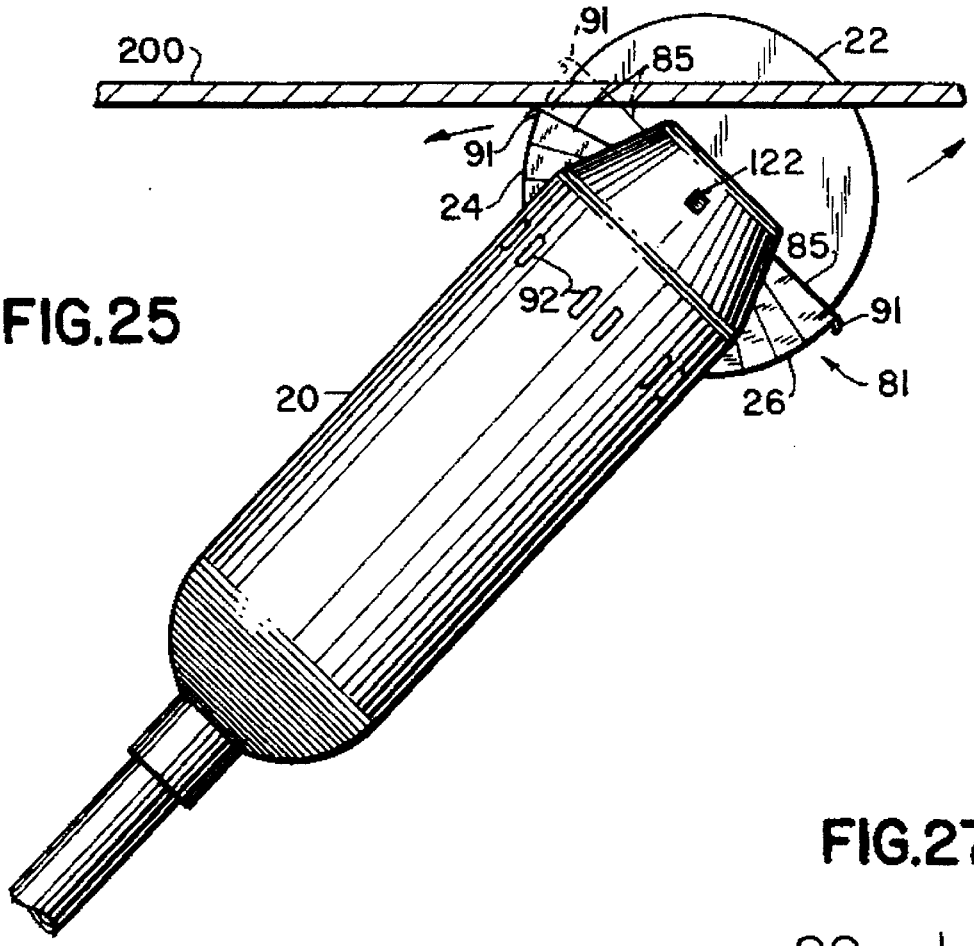
FIG.25
FIG.26
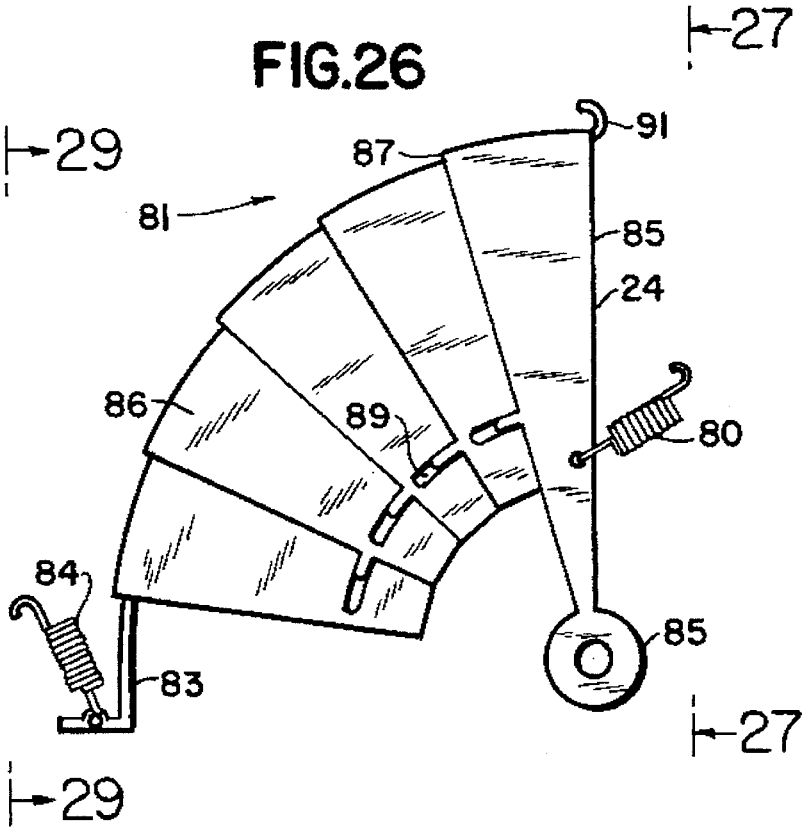
FIG.27
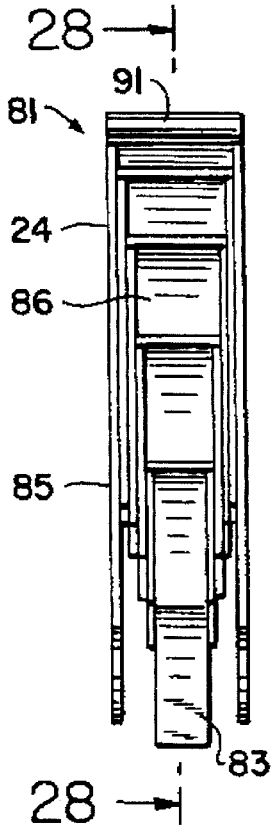

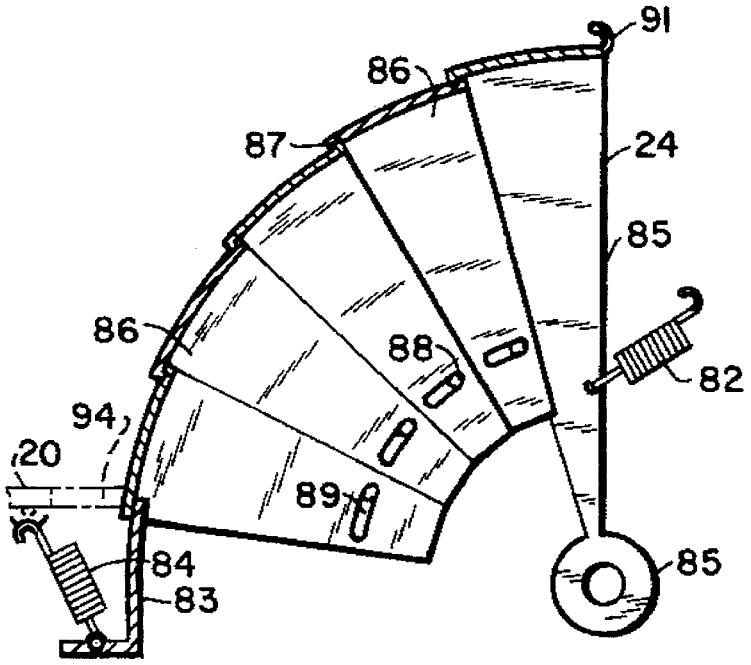
FIG.28
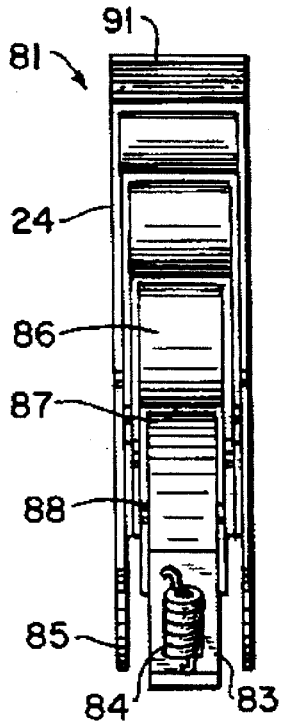
FIG.29
FIG.30
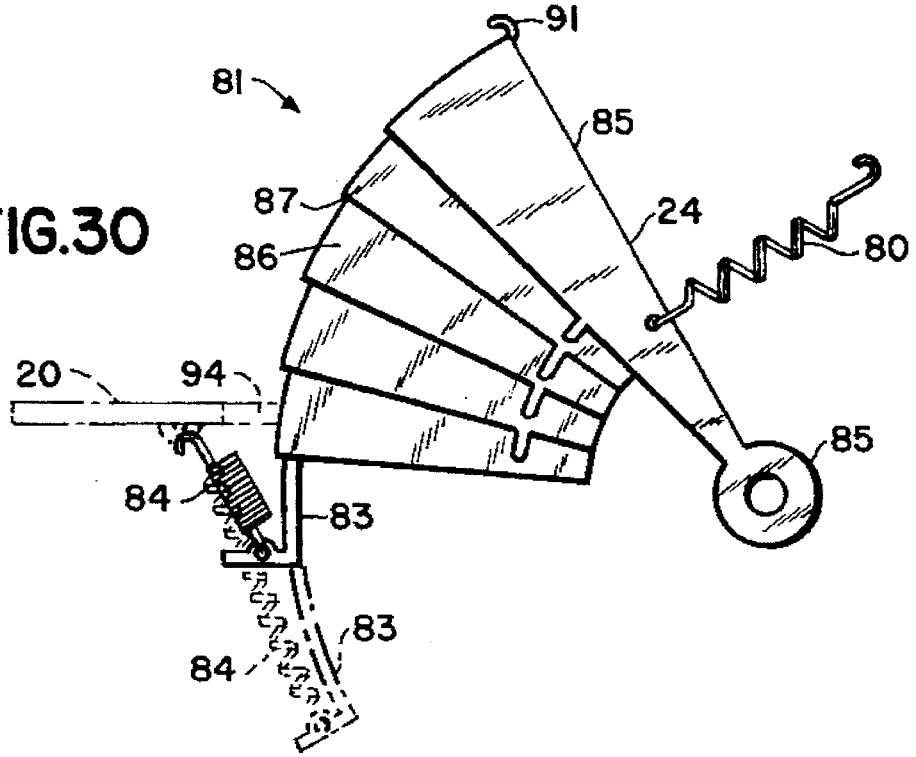

FIG.31
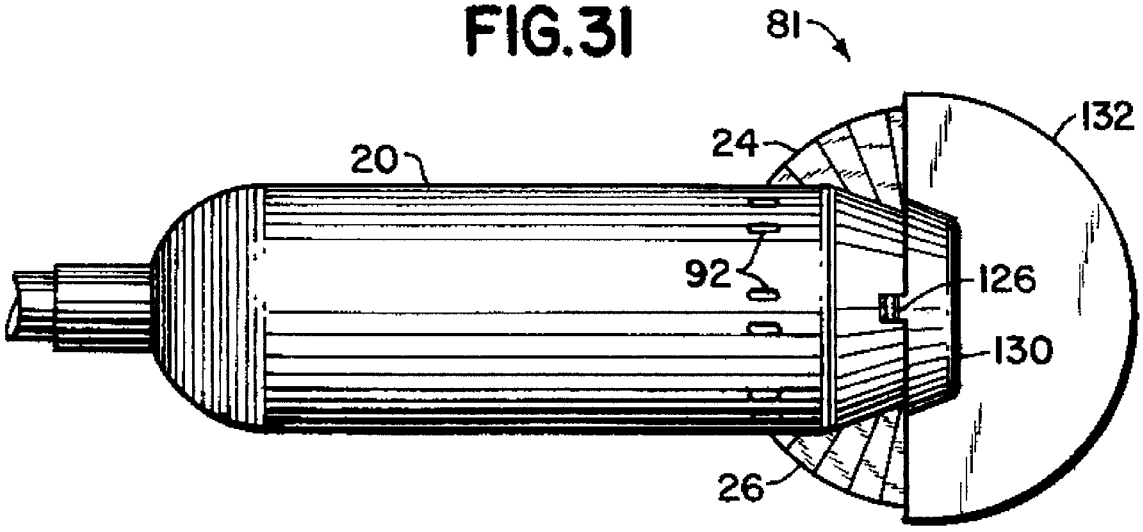
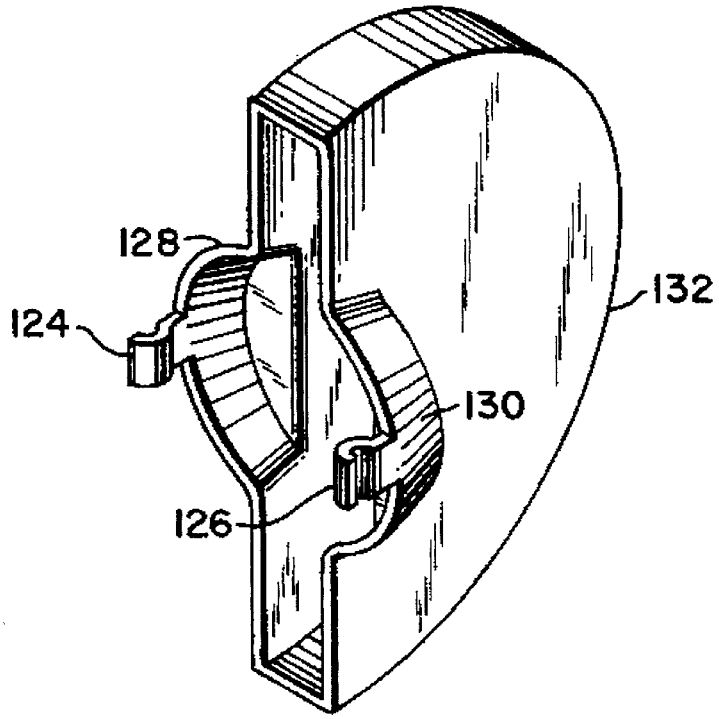
FIG.32

FIREFIGHTER'S CEILING CUTTING TOOL

BACKGROUND OF THE INVENTION

1. Field of the Invention

This invention is concerned with tools used in firefighting especially tools used in opening up ceilings and walls to gain access to fire in the building structure.

In fighting fires, it is essential that the fire be attacked at its source; for example in fighting an attic fire access is essential. The most universally used tool now is the familiar pike pole hook for pulling materials out of the way to gain access to the areas above the firefighter. The hook is punched through the material and then pulled. This is a very time consuming and tiring undertaking for the firefighters particularly in operating under extreme conditions of smoke and heat encountered in a structural fire. Often multiple punctures are required to remove insignificant area of a ceiling or a wall panel. There has been very little development of tools to accomplish these ends. There is a great need for a portable, light weight, designed power tool for utilization by firefighters to gain access to fire areas in ceilings as well as walls. It is the object of the present invention to provide a light weight, properly balanced and easily operated power tool to assist in the cutting of ceilings and walls for easy removal. According to the present invention, the ceiling will be cut into generally rectangular sections which will fall away from the ceiling when cut, or be easily pulled down by applying the pike pole hook to one edge thereof to pull away from any fastening devices used with nailed or glued panels.

2. Prior Art

Applicant does not know of any reference which discloses or suggests the firefighting tool of the present invention.

The following described references are the most relevant prior art which the applicant is aware of U.S. Pat. No. 4,271,909, Chatfield, Jr. et al., discloses a modular firefighting apparatus including a power module having a turbine driven by fluid, which can be a firefighting fluid, such as water or other extinguishing fluids. Various attachments can be placed on the tool including the circular saw described in FIG. 11 and the reciprocating saw in FIG. 14.

In U.S. Pat. No. 4,676,319, Cuthbertson, shows a firefighting tool which comprises a drill bit at the forward end of a shaft connected to a drill motor. The shaft is surrounded by a barrel which receives a firefighting fluid agent with an outlet opening at the forward end for dispensing the agent. This shaft is surrounded and cooled by the agent during the penetration operation in order to keep the barrel cool and lessen the chance of explosion in an explosive environment.

U.S. Pat. No. 4,760,646, Siegler, discloses a tree pruner and hedge clipper carried on the top of a telescoping boom containing transmission means of adjustable length.

U.S. Pat. No. 5,095,623, Williams, is a hand tool utilized by firefighters in sawing ceiling panels and essentially comprises a hand saw at the end of a pole.

U.S. Pat. No. 4,802,535, Bakke, shows a firefighting tool for penetrating a wall and, once penetrated holding it in place against removal while fire fighting agent dispersed to the end.

Of background interest are U.S. Pat. No. 4,985,997, Gross, St., disclosing a chain saw attachment for driving a circular saw and U.S. Pat. No. 4,286,675, Tuggle, discloses a power handle with quick connect and disconnect links for attaching brush cutters, drills, clippers and saws as well as portable air pumps.

SUMMARY OF THE INVENTION

In accordance with the present invention, it has provided a powered firefighters' tool for cutting and removing the ceiling structure to gain access to fire areas. In accordance with the present tool, ceilings including sheet rock, plaster and sheet metal are readily cut into sections for easy removal to gain access to the fire areas above. The device of the present invention consists of a circular saw having a universal blade carried on the end of an expandable, easily extensible boom. The rotating blade is oriented at the center of the tool with the motor driving it at the lower end in order to minimize the weight at the cutting end in order to facilitate its being held against the ceiling to be cut by the firefighter without unduly burdening the firefighter. The weight of the device is carried by the user's shoulder over which essentially a mounted sling is slung. The lower end of the device carries the counter weight for assisting in balance which is a retractable reel for the electric cord, which empowers the electric motor to drive the saw blade at the end of the boom. The handle controls for empowering the electric motor are neutral, forward and reverse. The blade control and a panic button are carried on the primary handle. The extensible boom is waterproofed and the saw blade extends from an enclosure at the end of the boom and has fan-like overlapping and like protection on either side.

BRIEF DESCRIPTION OF THE DRAWING

In the accompanying drawing which forms a part of the specification:

FIG. 10 is an enlarged sectional view along lines 10—10 of FIG. and of FIG. 19;

FIG. 11 is a plan view partly in section along lines 11—11 of FIG. 10.

FIG. 12 is a cross sectional view of electronic components of the device along lines 12—12 of FIG. 10 with interior components shown in phantom;

FIG. 25 is a side plan view of the power blade cutting into a ceiling surface and the blade guard retracting;

FIG. 26 is an enlarged view of the protective blade guard fan structure for the cutting blade;

FIG. 27 is an end view of the bladeguard along lines 27—27 of FIG. 26.

FIG. 28 is a sectional view of the guard along lines 28—28 of FIG. 27;

FIG. 29 is an end plan view of the guard along lines 29—29 of FIG. 26;

FIG. 30 is a side view of the fan guard showing the relative position of the fan segments and springs as the fan is folded down on itself;

FIG. 31 is a plan view of the power head with a protective cover in place over the blade; and FIG. 32 is a perspective view of the protective cover.

ILLUSTRATIVE PREFERRED SPECIFIC EMBODIMENT

Referring to the accompanying drawings, the device 2 of the present invention is 2 being carried into a fire environment by a firefighter 4.

Figure 2:
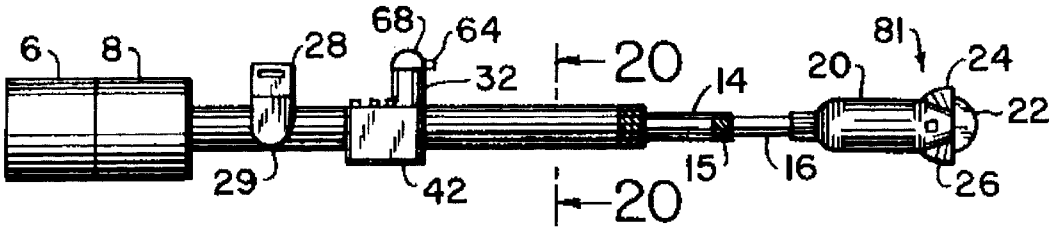
FIG. 2 is a side plan view of the device in its retracted condition.

The tool 2 is shown in its retracted state in FIG. 2 and comprises an adjustable weighted end 6, a wire reel containing section 8 from which extends a power cord 10, a base shaft section 36 and extendable sections 14 and 16 which are telescoped within the base section 36 the usual adjusting rings 13 and 15 being turnable to lock the telescoping tubular sections 14 and 16 respectively in the desired position;.

At the outer end of the tube 16 is a motor casement 20. Located and carried on the distal end 81 thereof is a circular blade 22. A pair of fan like guards 24 and 26 are secured to the casement 20 to partially enclose the blade 22 forming a shield 81 therefore when it is not being operated. As will be discussed in detail below, provision is made for a safety cover 200 to attach over the blade 22 when the tool 2 is not in use.

Figure 1:
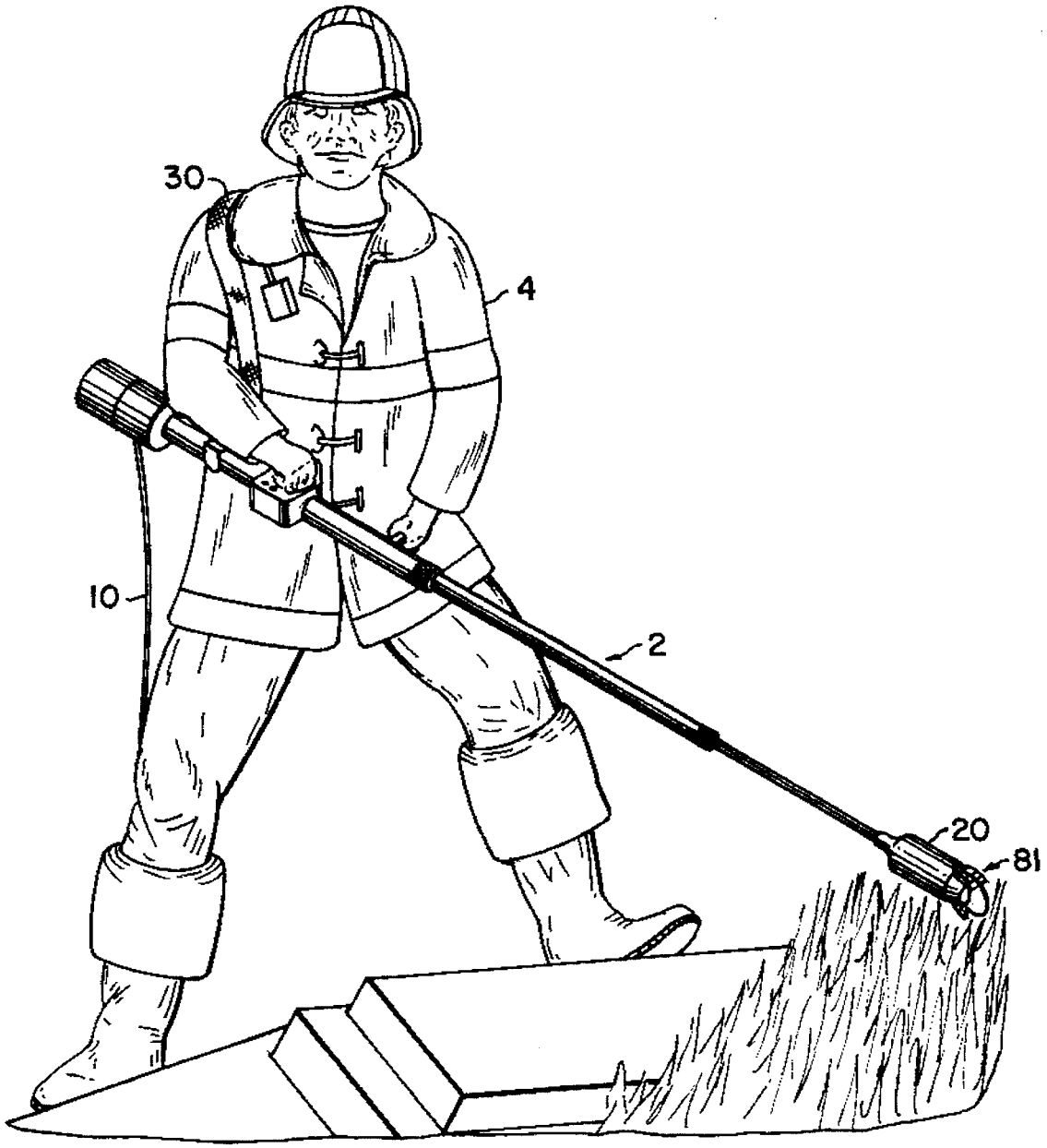
FIG. 1 is a view of a firefighter carrying the tool of the present invention.
Figure 3:
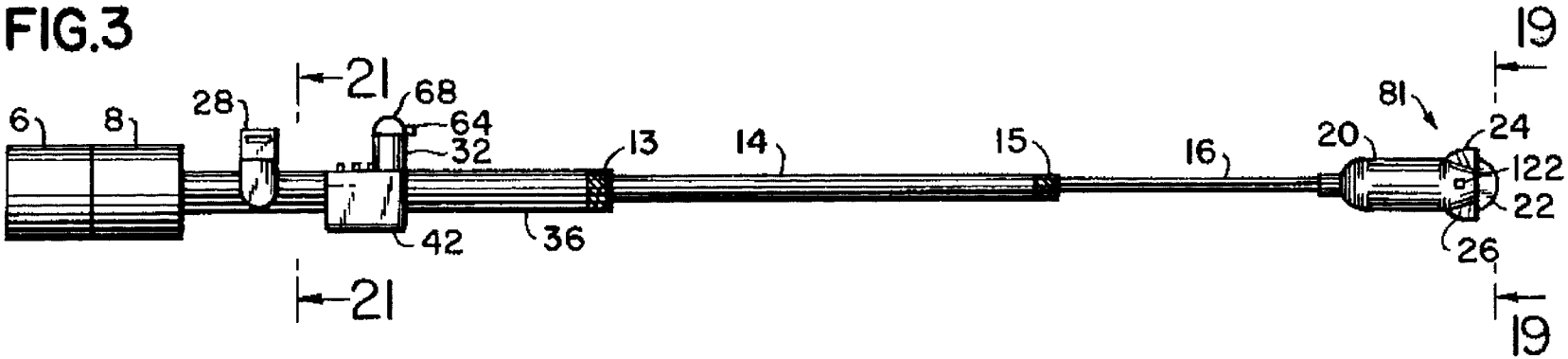
FIG. 3 is a side plan view of the device in its extended condition.
Figure 4:
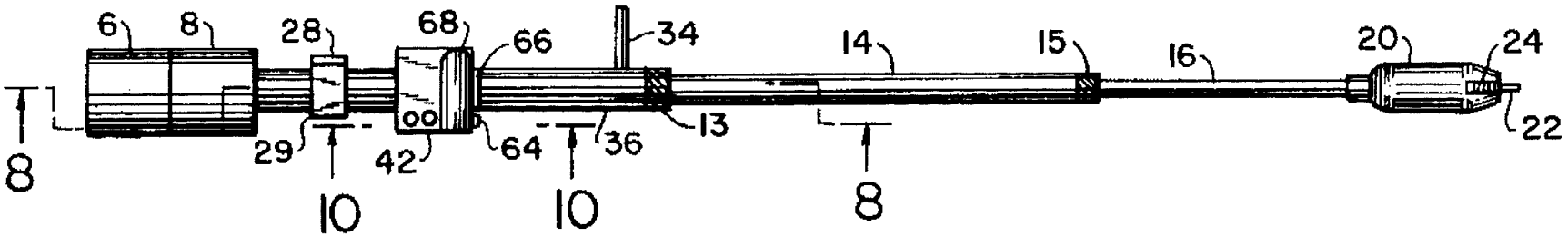
FIG. 4 is a top plan view of the device in its extended condition.

The tool 2 is shown in the extended condition with the tubes 14 and 16 extended in FIGS. 3 and 4. A bracket fixture 28 secured to the base section 36 by base bracket 29; is provided for attaching a carrying strap 30 as illustrated in FIG. 1 supporting the tool 2 over the shoulder of the firefighter 4 utilizing the tool 2. A primary control handle box includes push button controls 54, 56 and 58 described in detail below.

Positioned on the tube 36 at a 90 degree angle from the primary control handle 32 is an ancillary handle 34 which is threadably mounted on the lower side of the base of shaft 36. Depending on the ergonomic preferences of the manufacturer this auxilliary handle 34 could be placed at different angles relative to the primary control handle 32.

Figure 5:
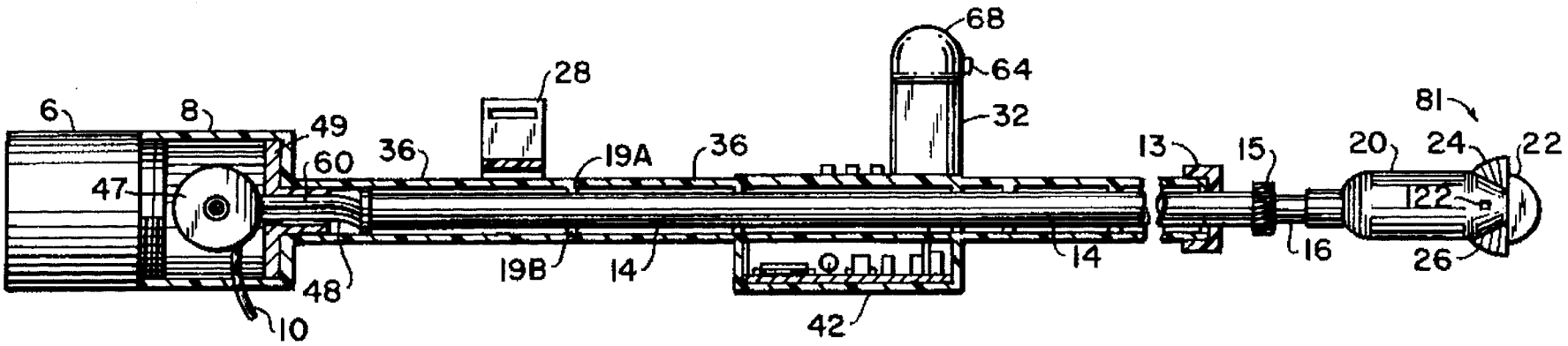
FIG. 5 is an enlarged sectional view taken along lines 8—8 of FIG. 4.

As shown in FIG. 5, enclosed within the outer tubular shell 36 comprising the shaft 12 is an inner tube 38 through which power control wires 60 leading to motor casement 20 is carried.

The tool 2 is provided with power from an external source through an insulated power cord 10 which enters the reel enclosure 8 through an opening 46 that is sealed against penetration by moisture. Inwardly projecting fingers 19A, 19B, and 19C slidingly engage corresponding slots in the shafts. The supply line 10 is connected to appropriate contacts on the reel 47 carried on spool shaft 43 out of which the spooled wire 60 wound in coils 45 goes to the motor 100 in casement 20. The reel enclosure 8 is sealed at the forward end by liner or seal 49 through which the wire 60 passes. Within the outer casing 36, on the inner surface 38 thereof, nibs 40 are provided to stabilize the device 2 against bending forces when the tubes 14 and 16 are extended.

Figure 6:
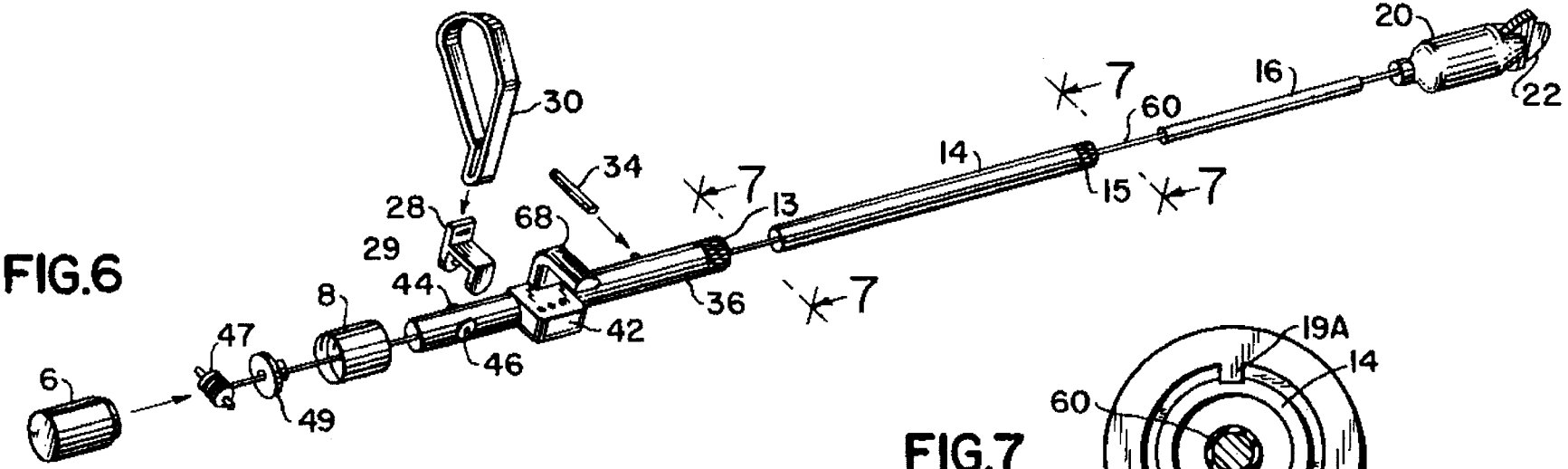
FIG. 6 is an exploded perspective view of the device of the present invention showing the component parts and their relationship to each other.
Figure 7:
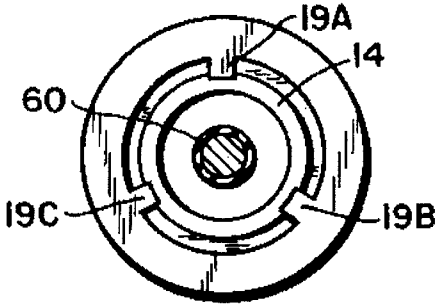
FIG. 7 is a partial sectional view along lines 7—7 of FIG. 6.

As shown in FIG. 6, the extendable tubes 14 and 16 slide within the outer shell 36 and are supported on the nibs 40. The power cord 60 running to the head 20 is shown within the tube 36 in FIG. 6.

Figure 8:
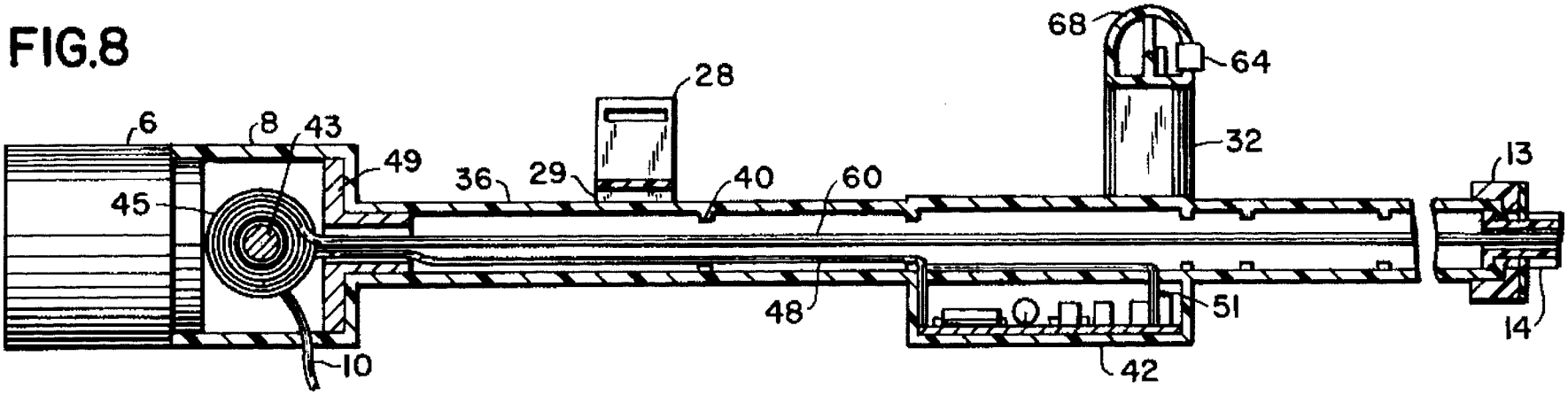
FIG. 8 is a partial sectional view along lines 8—8 of FIG. 4.
Figure 9:
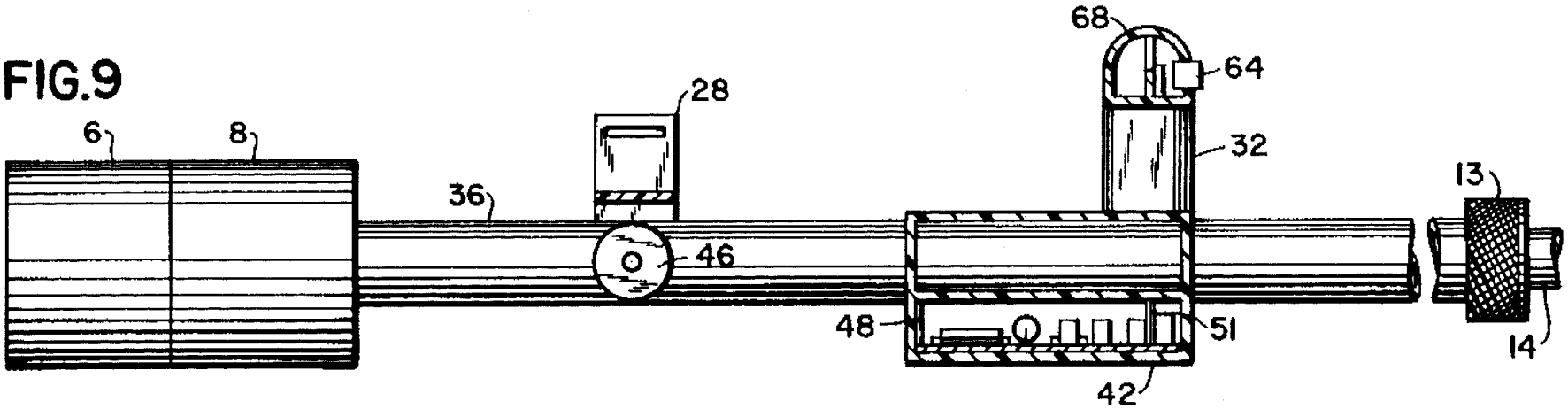
FIG. 9 is a side plan view of the lower portions of the device partially in section.

As shown best in FIG. 8, a control cord 48 and 51 run from the reel 47 mounted on shaft 43 along the inner walls of the tube 36 into the control box 42 in which the electronic components, on and off, and reverse controls are located. The power cord 60 which is on the reel 47 extends up through the center of the tube 36 and through the central cores of the telescopic tubes 14 and 16 as clearly indicated in FIG. 5. The control box 42 is constructed around outer tube 36.

The bracket 28 for the carrying strap 30 is secured by screws or the like in the base mounts 44 and 46 on either side of the shell 36.

Figure 13:
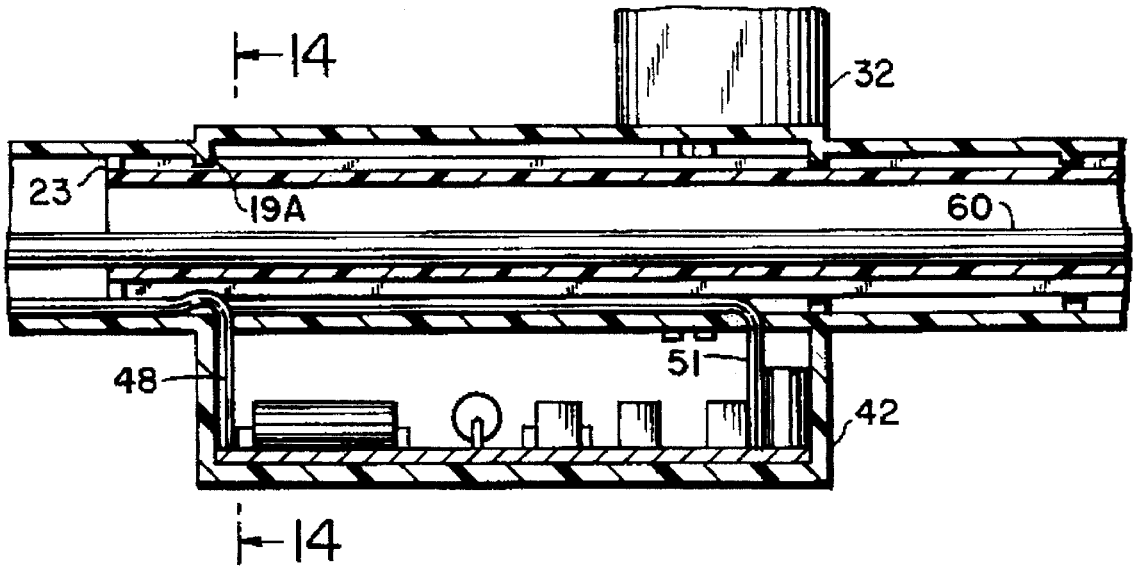
FIG. 13 is a sectional view of the electronic control box from the same point at FIG. 10, but with structure tubes shown in section along their longitudinal axis.
Figure 14:
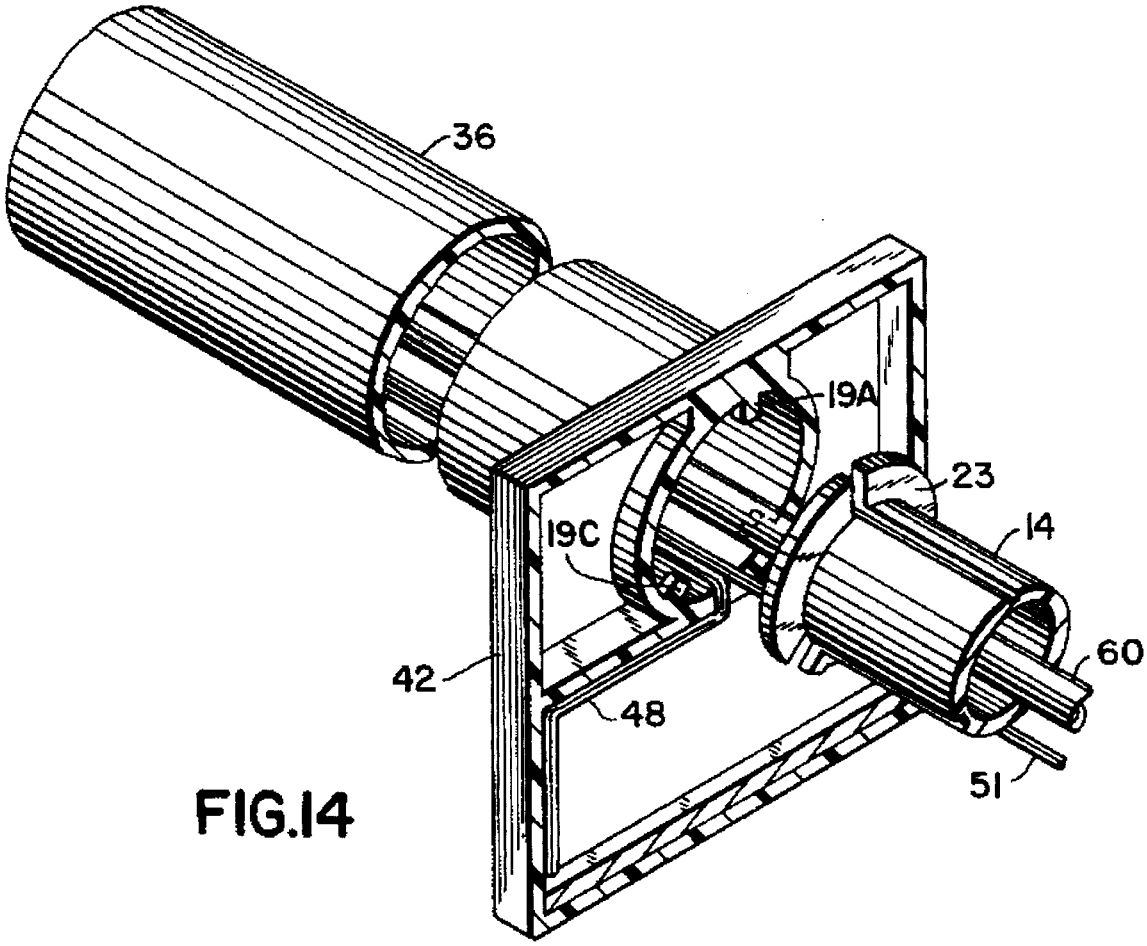
FIG. 14 is a perspective view of the outer tube, wires and rear wall of the control box and sealing means from the view of lines 14—14 of FIG. 13.

Referring in detail to FIGS. 10–14, the control box 42 is constructed to fit around the outer tube 36 in a sealed water tight manner as shown in FIGS. 13 and 14. The wires 48 and 51 coming from the reel 47 enter the rear wall 50 of the control box 42. The gasket seals the control box 42 relative to the tube 36.

As shown in FIG. 14, the power wire 60 to the head 20 passes through the inner tubes 14 and 16. Control buttons 54, 56, and 58 are provided in the box 42. ON and REVERSE and to control the direction of the rotation of the saw blade 22 in the power head 20.

The primary handle 32 extends up from the control box 42 and carries switches 64 and 66 in the upper grip 68 on the front side 70 thereof. The switch 64 in the upper part 68 of the handle 32 is basically an on/off switch for the firefighter 4 to operate when the tool 2 is initially placed in operation to reverse direction or to cut off all power one of the buttons are pushed.

Figure 15:
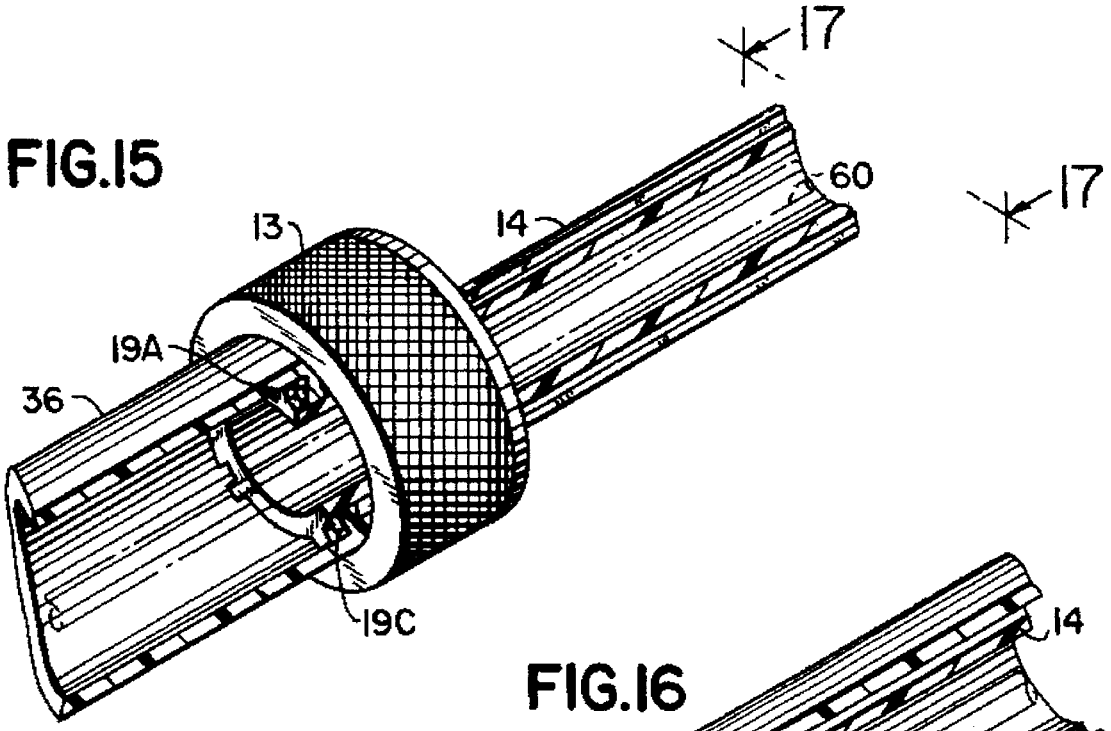
FIG. 15 is an enlarged sectional view of the tube extension mechanisms and guides.
Figure 16:
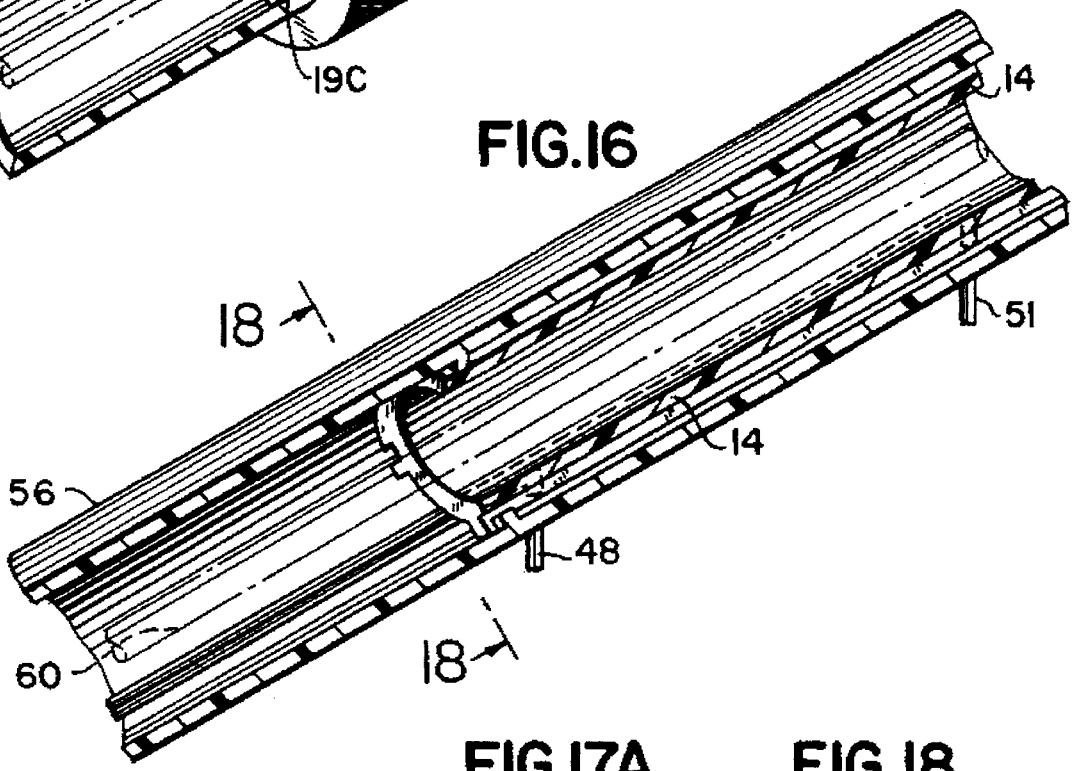
FIG. 16 is a cutaway view of the structure of FIG. 15.
Figure 17:
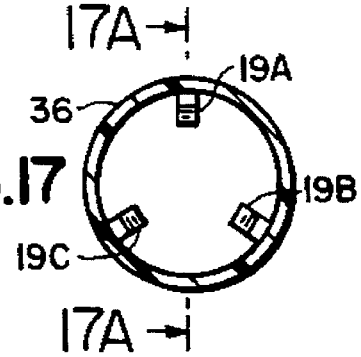
FIG. 17 is an end view of the guide means of FIG. 15.
Figure 17A:
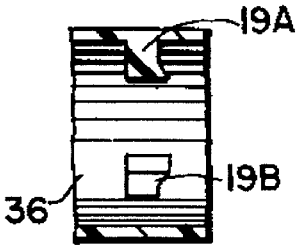
FIG. 17A is a sectional view along lines 17A of FIG. 17.
Figure 18:
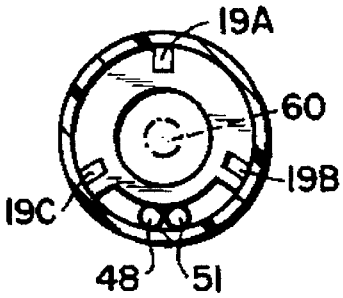
FIG. 18 is a cross sectional end view along lines 18—18 of FIG.

The manner in which the tubes 14 and 16 are extended is by the usual telescopic tube controls as shown in FIG. 15.

However, because it is highly desirable to maintain the interior of the extensible tubes 14 and 16 free of moisture, the sealing gaskets 74, and 76 are provided and have beveled faces (not shown) to deflect the water and facilitate the sealing of moisture from the interior of the extensible tubes 14 and 16.

Figure 19:
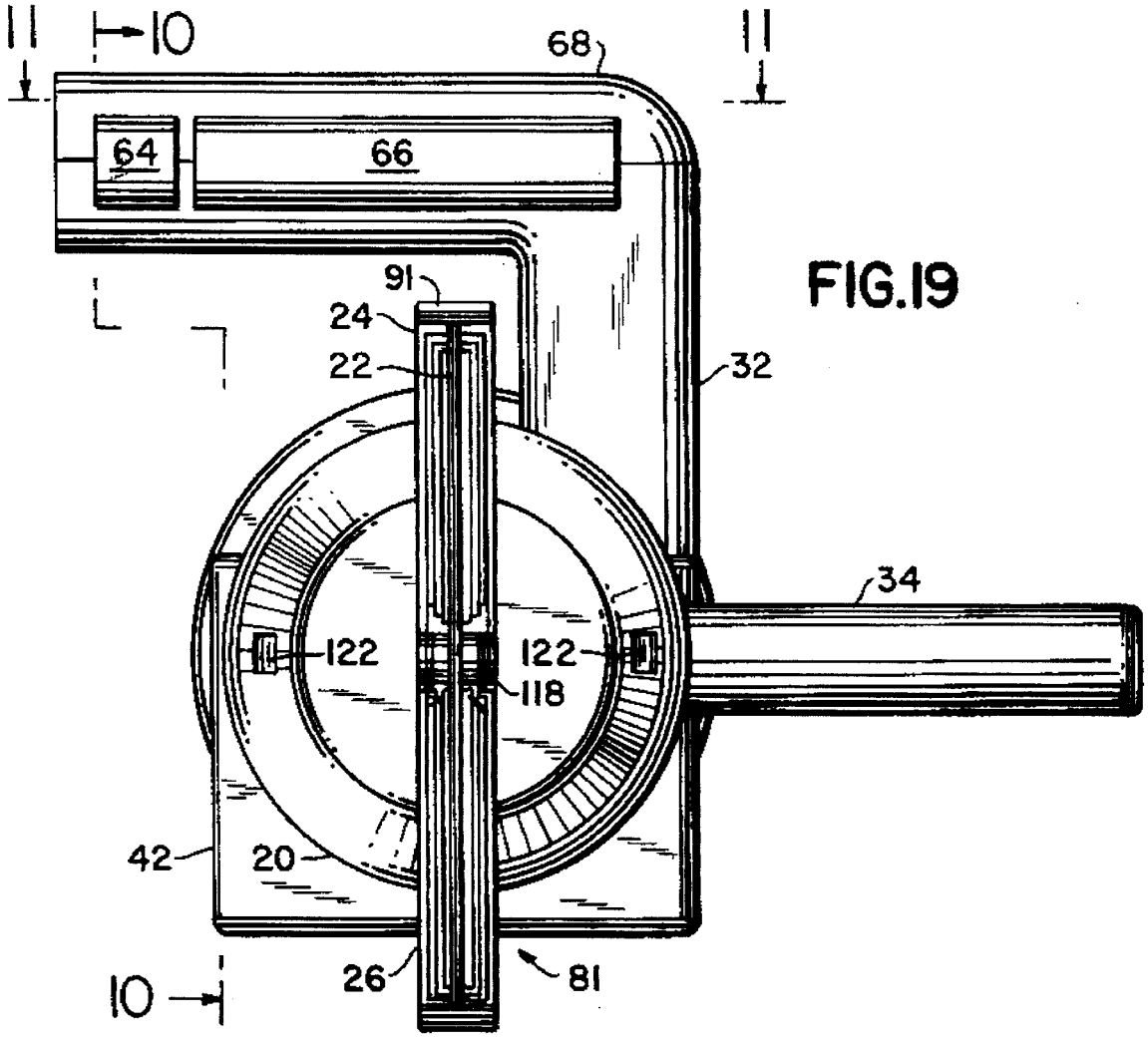
FIG. 19 is a front plan view from lines 19—19 for FIG. 3.
Figure 20:
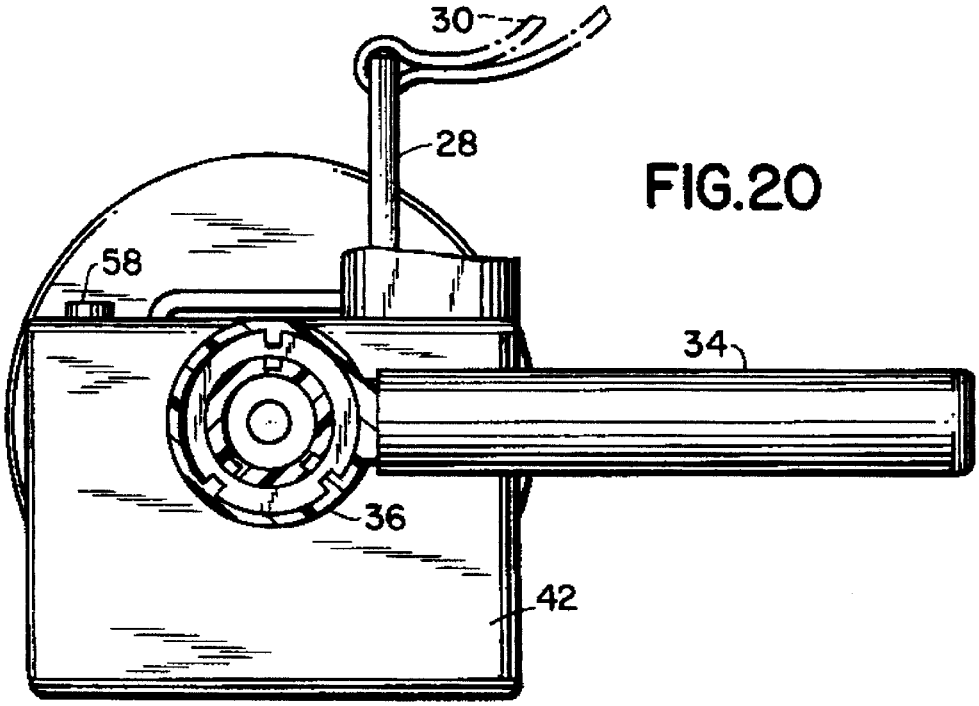
FIG. 20 is a front plan view partially in section along lines 20—20 of FIG. 2; with the control handle broken away.
Figure 21:
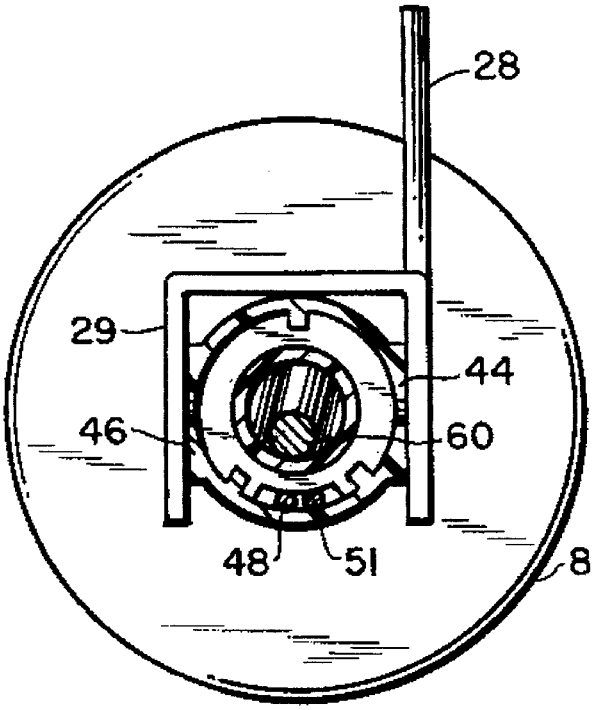
FIG. 21 is a view, partially, in section along lines 21—21 of FIG. 3.
Figure 22:
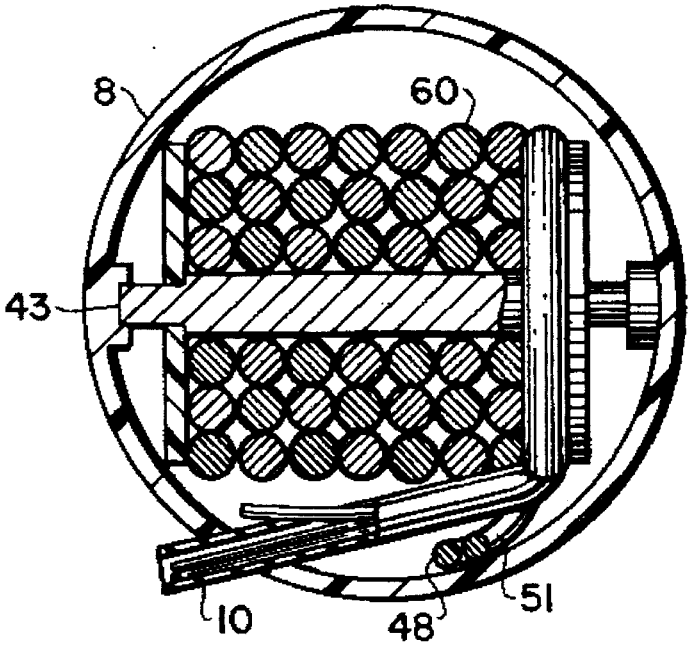
FIG. 22 is a cross sectional view showing the wire windings in the winding housing.
Figure 23:
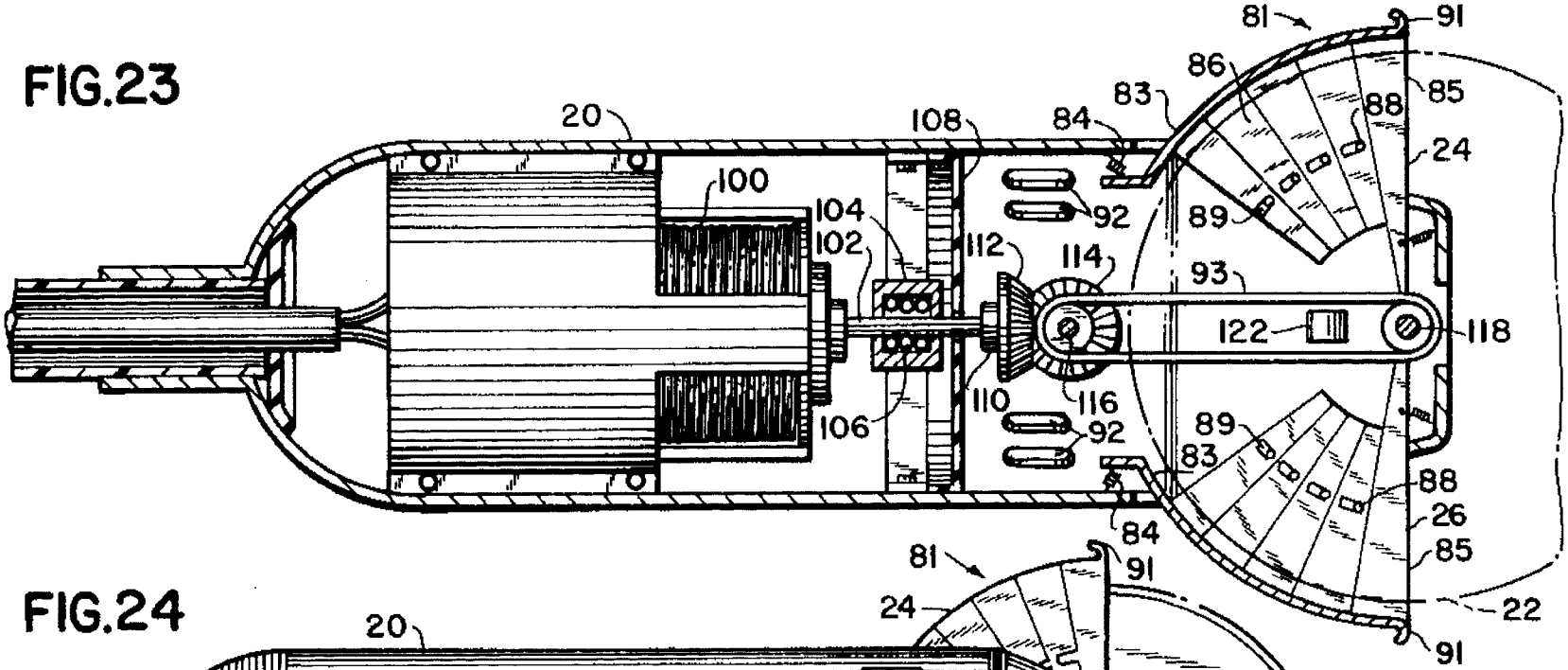
FIG. 23 is a cutaway view of the power head section along the longitudinal vertical axis.
Figure 24:
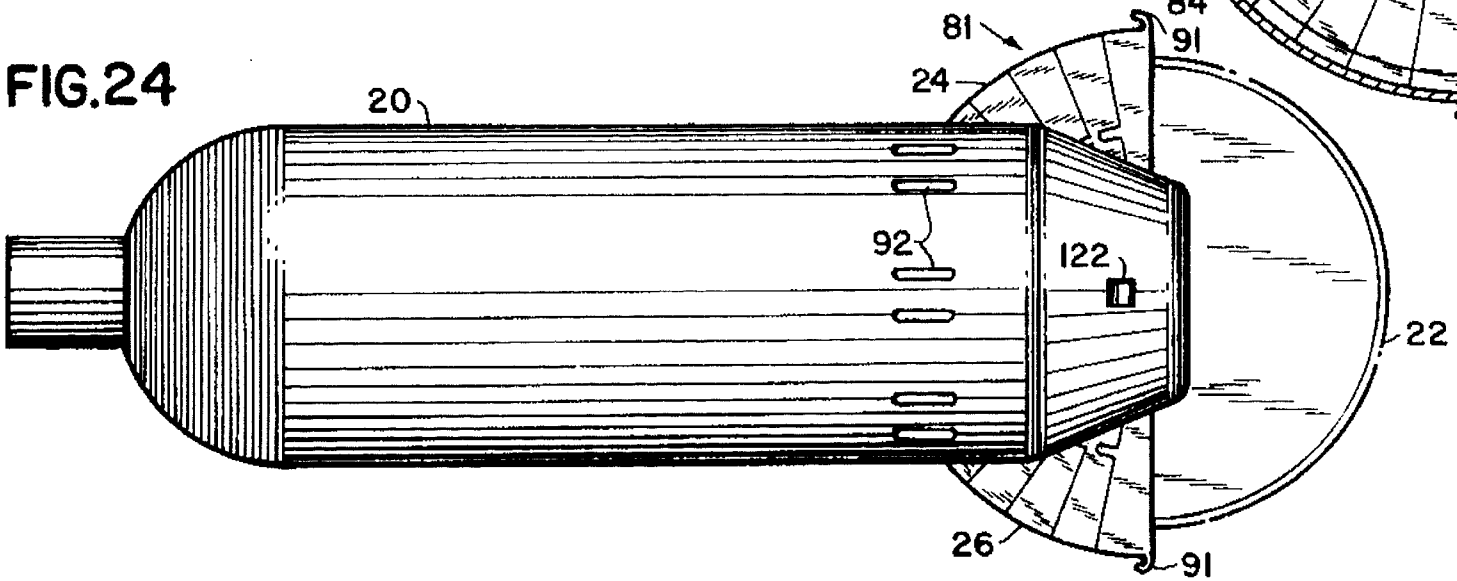
FIG. 24 is a side plan view of the power head portion of the device.

A view looking down from the operating end of the tool 2 is shown in FIG. 19. This illustrates the relationship of the orientation of the cutting tool head 20, the blade 22 to the rest of the tool 2. FIG. 20 also shows the relationships of the ancillary hand grip 34, the inner tubes and the carrying strap bracket 28 for the tool.

The head 20 carries the blade 22 which is lined up with the axes of the shafts 12, 14, and 16.

The motor 100 contained within the housing 20 is also mounted axially to maintain good balance. The drive shaft 102 of the motor 100 passes through a waterproof bearing mount 104, is channelled through ball bearings 106, and further through a sealed end closure 108 to prevent the penetration of water. The casement or housing 20 is provided with drain vents 92 to allow water to escape.

At the outer end 110 of the drive shaft 102 is a mounted gear 112 which engages a corresponding gear 114 mounted at 90 degrees on shaft 116 which in turn drives the belt 93 which rotates around the shaft 118 at the end of the head 20 to rotate the blade 22.

The blade 22 is shielded by a series of fan sections 24 and 26 with segments 86 which telescope within each other and are engaged sequentially by pins 88 in slots 89. One end has the hook 83 with a spring 84 biased so that it returns to the open position, but is easily depressed upon contact with wall surfaces and is pushed away to expose the substantial portion of the blade 22 as indicated best in FIG. 26. The fan like shields 24 and 26 over the top and bottom segments of the blade 22 comprise series of telescopic U shaped segments 86 with an outermost segment 85 which is secured over the ends of the shaft 118. The outer edge of the segment 85 is rounded at 91 in order to move smoothly along the wall or ceiling 200 when the blade 22 is operated as shown best in FIG. 25. The front and rear edge of each segment 86 is provided with fingers 87 to tie segments to each other and they are further stabilized by pins 88 which ride in slots 89 in each subsequent segment. The stacking feature is shown best in FIG. 30. The innermost end the last section 86 slides over a L shaped segment 83 which is secured to the inner side of the shell 20 by coil spring 84 as shown best in FIGS. 28 through 30. Appropriate slotted openings 94 are provided in the shell 20 to allow for the fan structures and blade. The outermost section 85 is biased towards the guarded position by a pair of coil springs 80 and 82 on each side of end piece 85. The outer casing 20 of the motor 100 is provided with depressed indentations 120 and 122 on each side in order to receive spring clamps 124 and 126 carried on the ears 128 and 130 extending just from a blade cover 132 as shown in FIG. 32 which can be placed over the blade 22 when the tool is not in use.

While the invention has been described by reference to an illustrative embodiment, it is not intended that the novel device be limited thereby, but that modifications thereof are intended to be included as falling within the broad spirit and scope of the foregoing disclosure, the following claims and the appended drawings.

What is claimed is:

1. A firefighters' tool for cleanly and safely cutting through ceiling and wall panels comprising a base shaft within which telescoping extendable tubular sections including an outermost tubular section may be retracted, said base shaft carrying a power cord reel having control wires extending therein to a control handle mounted on the exterior of said base shaft, a retractable power cord extending through a central core of said extendable tubular sections to a motor mounted at the distal end of said outermost telescoping tubular section, said motor being encased within a waterproof enclosure with a drive shaft of said motor turning concentrically with respect to the axes of said extendable tubular sections and said base shaft, gearing means connecting said motor to a belt driving means connecting said motor to a transverse shaft to rotate a circular cutting blade on an axis perpendicular to the central axis of said tubular sections and wherein the rotational axis of said blade is coincidental with the central axis of said tubular sections.

2. A tool is claimed in claim 1 wherein said motor is controlled from finger actuated control button switches mounted in a primary handle secured about the base shaft.

3. A tool is claimed in claim 2 wherein an auxiliary handle is provided mounted approximately 90 degrees from said primary handle.

4. A tool is claimed in any one of claims 1–3 wherein said blade is provided with a pair of fan like shields which are spring biased to substantially enclose the blade when it is not actively cutting and are retracted to expose the blade when slight pressure is applied thereto when the tool is in use, said fan like shields being biased to a safety position.

5. A tool is claimed in claim 4 provided with a safety guard to cover the blade when not in use.

6. A tool as claimed in claim 2 wherein said primary handle is provided with stop and go button controls on the upper portion thereof and reverse and on/off switches on the base thereof which override the switches on the grip portion of said primary handle.

* * * * *